United States Patent [19]

Knowles

[11] 4,188,083

[45] Feb. 12, 1980

[54] FLAT CABLE CONNECTOR WITH STRAIN RELIEF AND TWO-POSITION LATCH

[75] Inventor: Robert G. Knowles, Litchfield, Conn.

[73] Assignee: Litton Systems, Inc., Oakville, Conn.

[21] Appl. No.: 911,213

[22] Filed: Jun. 1, 1978

[51] Int. Cl.[2] ..... H01R 13/38

[52] U.S. Cl. ..... 339/99 R

[58] Field of Search ..... 339/97 P, 98, 99 R, 339/103

[56] References Cited

U.S. PATENT DOCUMENTS

| | | | |
|---|---|---|---|
| 3,702,982 | 11/1972 | Kelly et al. | 339/99 R |
| 3,994,554 | 11/1976 | Navarro | 339/99 R |
| 4,006,957 | 2/1977 | Narozny | 339/99 R |
| 4,009,921 | 3/1977 | Narozny | 339/99 R |

*Primary Examiner*—Joseph H. McGlynn
*Attorney, Agent, or Firm*—Brian L. Ribando

[57] ABSTRACT

A connector for terminating a flat cable comprises a contact support, a pressure member, and a strain relief. A metal clip on either end of the connector acts as a latch to maintain the three elements in a single package and to transmit the forces imposed by the strain relief directly to the contact support. A detent formed on the contact support provides a two-position catch for the latch. A protuberance formed on the clip bites into the end wall of the pressure member to prevent withdrawal of the clip from a slot formed in the pressure member and to allow displacement of the end wall in response to flexure of the clip.

5 Claims, 4 Drawing Figures

FLAT CABLE CONNECTOR WITH STRAIN RELIEF AND TWO-POSITION LATCH

BACKGROUND OF THE INVENTION

The invention relates to a connector for terminating flat multi-conductor cables in which a metal clip is used to retain a three member connector in a unitary package.

Connectors for terminating flat multi-conductor cables are well known in the prior art. The U.S. patent to Oshva, U.S. Pat. No. 3,355,699, discloses a ribbon cable connector in which two pressure bars are attached to either side of a central adaptor block. Each pressure bar includes a wedge-shaped member over which the ribbon cable is wrapped, and an intermediate contact block includes a plurality of pointed teeth which pierce the insulation on the ribbon cable and make electrical contact with the conductors located therein. The Oshva connector includes a strain relief of metal which is fastened to the pressure bar by means of jack screws and which is apertured to receive a tab formed on the adaptor block.

SUMMARY AND OBJECTS OF THE INVENTION

A connector used in terminating multi-conductor flat cables comprises a lower contact support which presents a plurality of insulation displacement contacts, a pressure member which forces the flat cable into a mating relationship with the insulation displacement contacts, and a strain relief. A rectangular metal clip mounts in slots formed on either end of the pressure member and acts to maintain the three elements in a single package. The clip transmits the forces which retain the strain relief, the pressure member, and the lower contact support together directly to the contact support without placing a load on the pressure member. A two-position catch is provided on the lower contact support for engagement with a latch portion of the metal clip. A barb-like protuberance is formed on the metal clip and this protuberance bites into the end wall of the pressure member to prevent withdrawal of the clip from the slot formed therein. The protuberance additionally allows greater movement of the latch portions of the clip by acting as a pivot surface which bears on the internal surface of the end wall. Displacement of the latch portions of the clip results in a flexure of the end wall.

It is therefore an object of the present invention to provide a flat cable connector with a strain relief and a two-position latch.

It is another object of the invention to provide a flat cable connector comprising a strain relief, a pressure member, and a lower contact support, three elements being maintained in an assembled relationship by a two-position metal latch.

It is another object of the invention to provide a flat cable connector for terminating a multi-conductor cable wherein the connector comprises a pressure member in which are mounted two metal clips which act to retain a strain relief and a lower contact support in assembled relationship with the pressure member, and wherein the clip cooperates with a two-position catch formed on the lower contact support.

These and other objects of the invention will become apparent from the following detailed description taken in conjunction with the accompanying drawing figures in which like reference numerals designate like or corresponding parts throughout the figures.

DESCRIPTION OF THE PREFERRED EMBODIMENT

Figure 1:
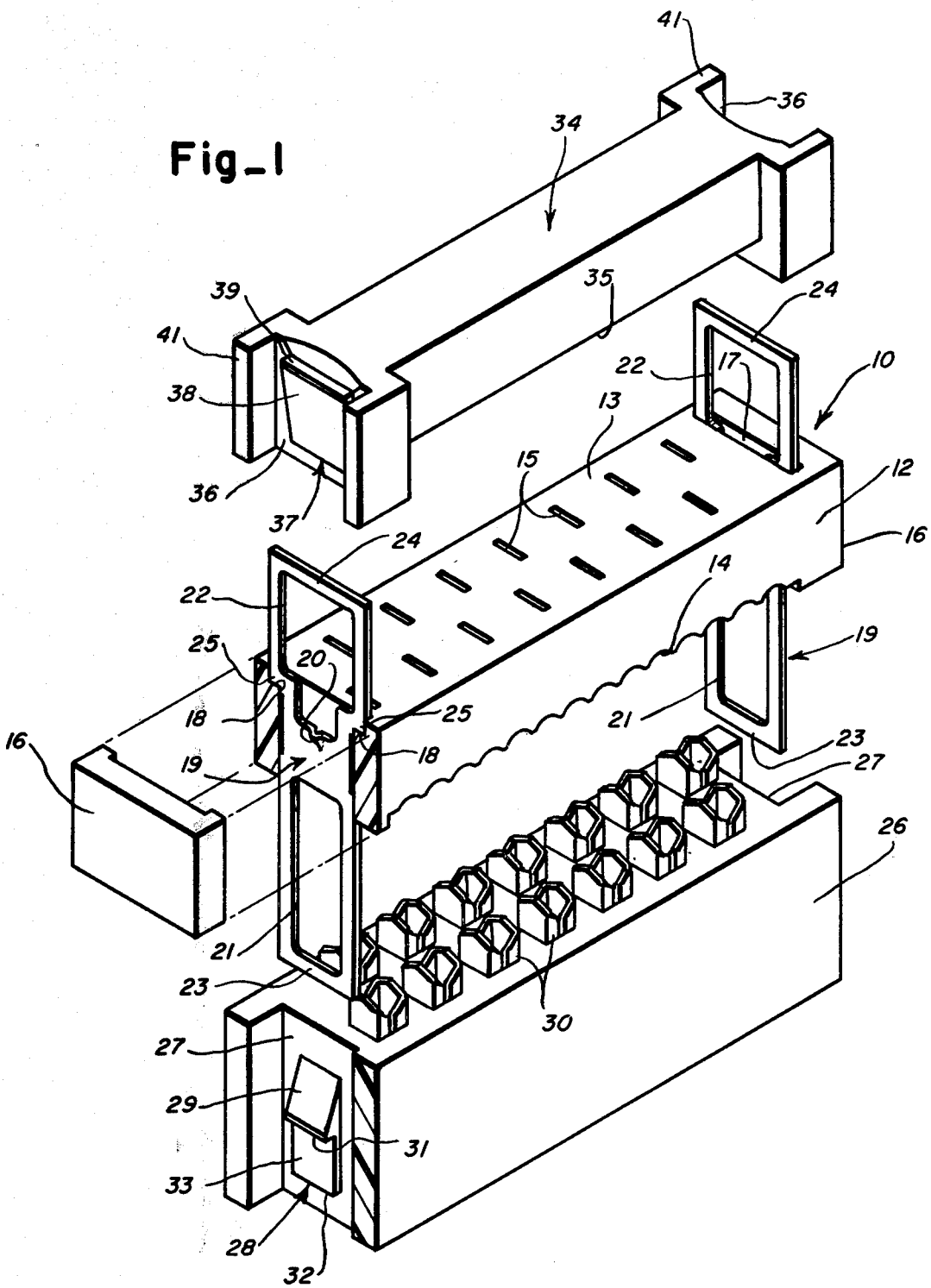
FIG. 1 is an exploded view of the flat cable connector of the invention.

Referring now to the drawings, there is shown in FIG. 1 a flat cable connector generally designated by reference numeral 10. The connector comprises a pressure member 12 having an upper surface 13, a lower sculpted surface 14, and end walls 16. The upper surface 13 is provided with a plurality of probe access slots 15 which allow a test probe to be inserted into the interior of the connector when the connector is in a partially assembled state. Between each of the end walls 16 and the main body of the pressure member 12 is formed a slot 17 including a ledge 18 which is dimensioned to receive a clip 19. In a preferred embodiment, the clip 19 is formed of metal and includes a barb-like protuberance 20 and shoulders 25. Two generally rectangular openings 21 and 22 are formed in the clip 19 and these openings create latch portions 23 and 24.

The connector further comprises a lower contact support 26 in which is mounted a plurality of insulation displacement contacts 30. On either end of the lower contact support 26 is a channel 27 and located within each channel 27 is a detent 28. The detent 28 includes a bevel 29 which provides a sloped surface from the channel 27 to a first catch 31. A second catch 32 is provided on the lower surface of the detent 28 and a support surface 33 exists between the first catch 31 and the second catch 32.

The connector further comprises a strain relief 34 having a channel 36 on each end thereof. Located within each channel 36 is a detent 37 comprising a beveled surface 38 and a catch 39. It will be noted that the ends 41 of the strain relief in which the channels 36 are located have a greater height than the main body of the strain relief 34 for reasons which will be explained more fully herein below.

Figure 2:
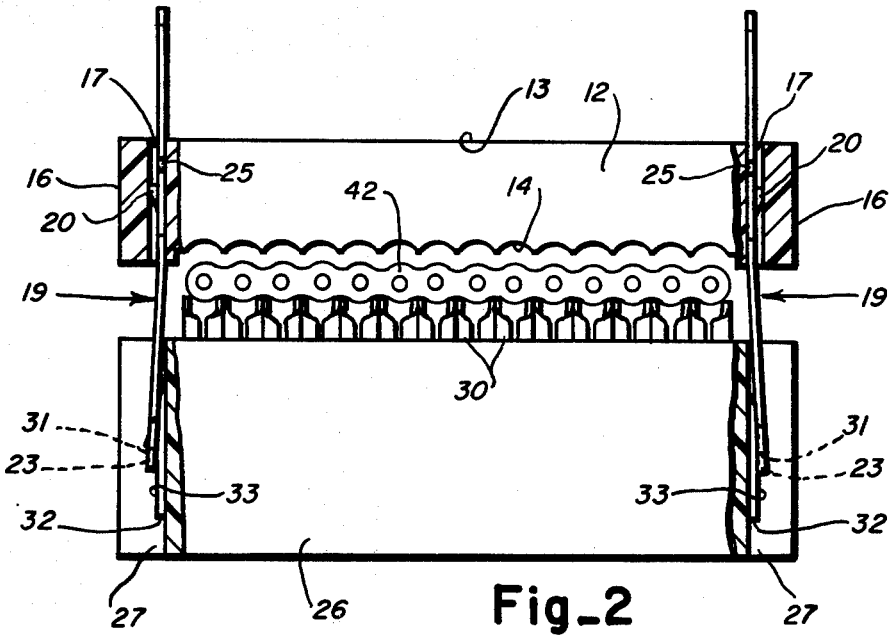
FIG. 2 is a side view partially in section showing a pressure member retained to the lower contact support in the first latching position.
Figure 4:
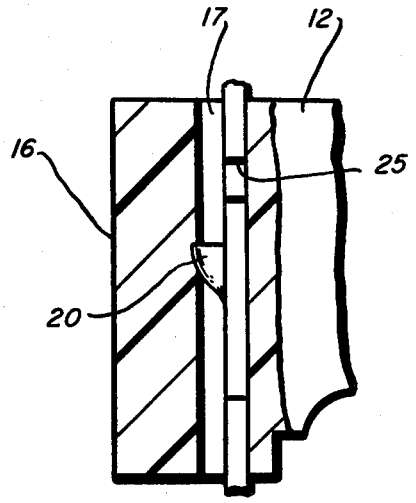
FIG. 4 is an enlarged view of a portion of FIG. 2 showing a metal clip engaged in a slot in the pressure member.

Turning now to FIG. 2, the pressure member 12 is shown in partially assembled relationship with the lower contact support 26. The latch 23 rests on the support surface 33 and withdrawal of the latch 23 from the detent 28 is prevented by the provision of the first catch 31. The barb-like protuberance 20 engages the inside surface of the end walls 16, and the shape of the protuberance 20 allows the clip 19 to be inserted into the slot 17 until the shoulder 25 thereof comes into engagement with the ledge 18 which is a part of the slot 17. Removal of the clip 19 from the slot 17 is made difficult because of the sharp edge of the protuberance 20 which is set in biting engagement with the inner surface of the end wall 16 as is shown more clearly in FIG. 4. Displacement of an end of the clip 19 causes the protuberance 20 to bear on the end wall 16 which is sufficiently plastic in nature so as to flex slightly allowing for displacement of the clip within the slot 17. In this partially assembled state, sufficient clearance space exists between the sculpted surface 14 and the top of the several insulation displacement contacts 30 to enable a flat multi-conductor cable 42 to be placed therein.

Figure 3:
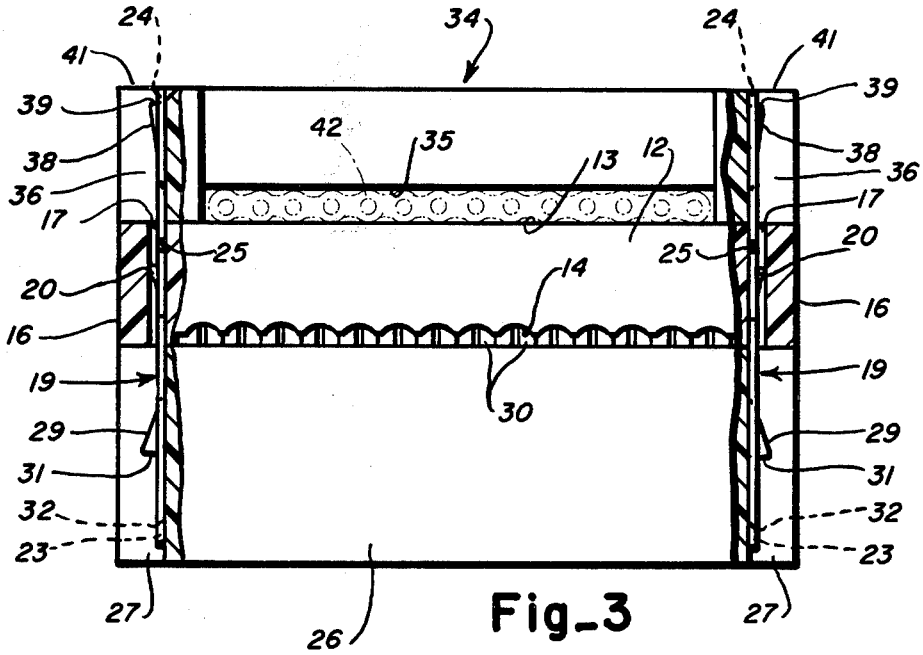
FIG. 3 is a side view partially in section showing a pressure member retained to the lower contact support in the second latching position and the strain relief retained to the pressure member.

Turning now to FIG. 3, the three members of the connector are shown in an assembled relationship. The latch 23 of the clip 19 is engaged by the second catch 32 which prevents removal of the clip from the channel 27. The strain relief 34 is locked to the pressure member 12 by means of the engagement of the latch 24 with the catch 39. Sufficient space exists between the lower edge 35 of the strain relief 34 and the upper surface 13 of the pressure member 12 to allow the flat cable 42 to be disposed therebetween in a pinched condition.

The use of the device should be apparent to those skilled in the art. Alignment of the pressure member 12 with the lower contact support 26 and the application of a slight force thereto will cause the latch portions 23 of the clips 19 to be engaged by the first catches 31 of the detents 28. The device may be maintained in this condition until termination use is desired at which time a flat conductor cable 42 can be inserted between the pressure member 12 and the lower contact support 26 and looped over the pressure member 12. The strain relief 34 can then be aligned with the top surface of the pressure member 12 and force applied thereto to cause the latches 24 of the clip 19 to be caught by the catches 39, and the latches 23 to be caught by the second catches 32. Displacement of the three members of the connector device in a direction toward one another will cause the cable 42 to be pinched between the strain relief 34 and the pressure member 12, and the insulation displacement contacts 30 to pierce and make contact with the conductors within the flat cable with an electrical connection being made thereby. The clip 19 transmits the force imposed on the strain relief 34 therefrom directly to the lower contact support 26 without imposing a load upon the pressure member 12.

Alterations and modifications will occur to those skilled in the art. For instance, the protuberance formed on the metal clip may take a shape other than that which is specifically shown. Additionally, a two-position catch may be provided on the strain relief 34 so that this member can be retained in a first position to the remaining two members of the connector. A cable to be terminated could be threaded first through the space between the strain relief and the pressure member and then through the space between the pressure member and the lower contact support. Only a subsequent application of force would be needed to cause the connector to terminate the cable.

Other modifications and alterations to the invention as described will occur to those skilled in the art, which modifications and alterations are intended to be within the scope of the present invention as defined in the appended claims.

I claim:

1. In a connector for terminating flat multi-conductor cables including a lower contact support in which is mounted a plurality of insulation displacement contacts, a pressure member having a pair of end walls on opposite ends thereof, and a strain relief, the combination comprising:

clip means for transmitting stress from said strain relief to said lower contact support, slot means at either end of said pressure member for receiving said clip means, means for holding said clip means in said slot means, a first latch portion formed on one end of each of said clip means and a second latch portion formed on another end of each of said clip means, first detents formed on opposite end surfaces of said lower contact support, second detents formed on opposite end surfaces of said strain relief, first catch means on each of said first detents for engaging said first latch portions, second catch means on each of said first detents for engaging said first latch portions, third catch means on each of said second detents for engaging said second latch portions, and support surfaces between said first catch means and said second catch means for supporting said first latch portions.

2. The combination of claim 1 further comprising:

a ledge formed in each of said slot means, and shoulder means on said clip means for abutting said ledges and limiting the travel of said clip means into said slot means.

3. The combination of claim 2 further comprising:

bevel means on said first detents for providing a smooth transition between the end surfaces of said lower contact support and said first catch means.

4. The combination of claim 3 further comprising:

barb-like protuberances comprising said means for holding, said barb-like protuberances bearing on the inside surface of said end walls.

5. The combination of claim 4 further comprising:

bevel means on said second detents for providing a smooth transition between the end surfaces of said strain relief and said third catch means.

* * * * *